US009880516B2

(12) United States Patent
Yoon et al.

(10) Patent No.: US 9,880,516 B2
(45) Date of Patent: Jan. 30, 2018

(54) IMAGE FORMING APPARATUS PROVIDED WITH A DEVELOPING UNIT STORAGE PORTION AND A DEVELOPING UNIT MOUNTING PORTION

(71) Applicant: S-PRINTING SOLUTION CO., LTD., Suwon-si, Gyeonggi-do (KR)

(72) Inventors: Hwan Jin Yoon, Suwon-si (KR); Jeong Jae Seong, Namyangju-si (KR); Wan Ho Lee, Suwon-si (KR); Jeong Won Hwang, Changwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 172 days.

(21) Appl. No.: 14/142,034

(22) Filed: Dec. 27, 2013

(65) Prior Publication Data

US 2014/0199095 A1 Jul. 17, 2014

(30) Foreign Application Priority Data

Jan. 16, 2013 (KR) ..... 10-2013-0004842

(51) Int. Cl.
*G03G 21/16* (2006.01)
*G03G 21/18* (2006.01)

(52) U.S. Cl.
CPC ..... *G03G 21/1676* (2013.01); *G03G 21/1604* (2013.01); *G03G 21/185* (2013.01);
(Continued)

(58) Field of Classification Search
CPC ..... G03G 21/16; G03G 21/1604; G03G 21/1609; G03G 21/1619; G03G 21/18;
(Continued)

(56) References Cited

U.S. PATENT DOCUMENTS 7,751,747 B2 * 7/2010 Lee et al. ..... 399/111
8,095,045 B2 * 1/2012 Takashima ..... 399/227
(Continued)

FOREIGN PATENT DOCUMENTS

JP 09-218557 8/1997
JP 2002-174937 6/2002
(Continued)

OTHER PUBLICATIONS

International Search Report dated Apr. 25, 2014 of International Application No. PCT/KR2014/000378, 3 pages.

*Primary Examiner* — Joseph S Wong
(74) *Attorney, Agent, or Firm* — Staas & Halsey LLP

(57) ABSTRACT

An image forming apparatus has an improved structure which avoids additional expenses associated with packing a developing unit and allows the developing unit to be stably stored. The image forming apparatus may include a body, a first developing unit accommodating portion and a second developing unit accommodating portion disposed at different positions in the body, and a developing unit which is allowed to be detachably accommodated in the first developing unit accommodating portion and the second developing unit accommodating portion. When accommodated in the first developing unit accommodating portion, the developing unit may be disposed such that it does not perform image formation. When accommodated in the second developing unit accommodating portion, the developing unit may be disposed to perform image formation.

22 Claims, 15 Drawing Sheets

(52) U.S. Cl.
CPC ..... *G03G 21/16* (2013.01); *G03G 21/1609* (2013.01); *G03G 21/1619* (2013.01); *G03G 21/18* (2013.01); *G03G 21/1839* (2013.01); *G03G 21/1842* (2013.01); *G03G 2221/1684* (2013.01); *G03G 2221/18* (2013.01); *G03G 2221/1884* (2013.01)

(58) Field of Classification Search
CPC ..... G03G 21/1839; G03G 21/1842; G03G 2221/18; G03G 2221/1884; G03G 21/1676; G03G 2221/1684; G03G 21/185
See application file for complete search history.

(56) References Cited

U.S. PATENT DOCUMENTS

| | | | | |
|---|---|---|---|---|
| 2002/0195915 | A1* | 12/2002 | Katsuyama et al. ..... | 312/330.1 |
| 2003/0113135 | A1 | 6/2003 | Lange et al. | |
| 2004/0028419 | A1 | 2/2004 | Kato | |
| 2006/0216062 | A1* | 9/2006 | Kawai ..... | G03G 21/185 399/111 |
| 2011/0222920 | A1* | 9/2011 | Kobayashi ..... | G03G 15/0194 399/299 |

FOREIGN PATENT DOCUMENTS

| | | |
|---|---|---|
| JP | 2003-186359 | 7/2003 |
| JP | 2003-208073 | 7/2003 |
| JP | 2005-31392 | 2/2005 |
| JP | 2005-242119 | 9/2005 |

* cited by examiner

IMAGE FORMING APPARATUS PROVIDED WITH A DEVELOPING UNIT STORAGE PORTION AND A DEVELOPING UNIT MOUNTING PORTION

CROSS-REFERENCE TO RELATED APPLICATIONS

This application claims the priority benefit of Korean Patent Application No. 10-2013-0004842, filed on Jan. 16, 2013 in the Korean Intellectual Property Office, the disclosure of which is incorporated herein by reference.

BACKGROUND

1. Field

Embodiments disclosed herein relate to an image forming apparatus having a structure to pack a developing unit which performs an operation of image formation.

2. Description of the Related Art

An image forming apparatus refers to an apparatus to form an image on a printing medium according to an input signal. Examples of such an image forming apparatus include a printer, a copier, a facsimile machine, and a multifunction device. The multifunction device may combine two or more functions of the above-mentioned appliances (e.g., the printer, copier, and/or facsimile machine).

The image forming apparatus generally includes a body to stack or feed sheets of paper and to support or drive various components therein, and a developing unit mounted to the body to form an image on a sheet of paper.

Techniques generally used to pack the developing unit detachably mounted to the body include packing the body and the developing unit separately in different packing boxes, disposing the body and the developing unit at different positions in one packing box, and mounting the developing unit to the body at a position of developing operation.

However, in the case of packing the body and the developing unit in different packing boxes, separately packing the developing unit may incur additional expenses. That is, additional time and/or materials may be required to separately pack the body and developing unit. In addition, disposing the body and the developing unit at different positions in one packing box may increase the size of the packing box. In the case of mounting the developing unit to the body at a position of the developing operation, the developing unit may be damaged during transport due to shock occurring when components of the developing unit contact components in the body.

SUMMARY

Therefore, it is an aspect of the present invention to provide an image forming apparatus having an improved structure which does not incur separate and/or additional expenses for packing of a developing unit and allows the developing unit to be stably stored.

Additional aspects of the invention will be set forth in part in the description which follows and, in part, will be apparent from the description, or may be learned from practice of the invention.

In accordance with one aspect of the present invention, an image forming apparatus may include a body, a developing unit mounting portion, and a developing unit mounted to the developing unit mounting portion and arranged to perform image formation. The image forming apparatus may further include a developing unit storage portion provided in the body to accommodate the developing unit, separately from the developing unit mounting portion, wherein the developing unit is stored in the developing unit storage portion prior to a first operation of the image forming apparatus, and is separated from the developing unit storage portion and mounted to the developing unit mounting portion to perform the first operation of the image forming apparatus.

The developing unit mounting portion may be arranged relatively closer to a path along which a recording medium is transported, compared to the developing unit storage portion.

The developing unit storage portion and the developing unit mounting portion may be arranged parallel to each other in a front-back direction of the body.

An optical scanning unit may be disposed between the developing unit storage portion and the developing unit mounting portion.

The developing unit may include a photosensitive body to form an electrostatic latent image, and a developing roller to supply toner to the photosensitive body, wherein, when the developing unit is accommodated and disposed in the developing unit mounting portion, the photosensitive body may form at least one portion of the path along which the recording medium is transported.

The image forming apparatus may further include a first opening provided on a front surface of the body to allow the developing unit to enter the developing unit storage portion, and a second opening provided on the front surface of the body to allow the developing unit to enter the developing unit mounting portion.

The image forming apparatus may further include a first cover to cover the first opening, and a second cover to cover the second opening.

The image forming apparatus may further include a third cover to cover the first cover and the second cover.

The image forming apparatus may further include a front frame to form the first opening and the second opening.

The developing unit may include at least one first position determining protrusion protruding from one side of the developing unit in a direction in which the developing unit enters the developing unit storage portion, wherein the front frame may include at least one first coupling hole formed at a position corresponding to the first position determining protrusion to be coupled to the at least one first position determining protrusion.

The developing unit may include at least one first fixing hole formed through the one side of the developing unit, wherein the front frame may include at least one second fixing hole formed at a position corresponding to the at least one first fixing hole through the front frame.

The image forming apparatus may further include at least one guide member formed to extend in a front-back direction of the body and disposed at a lower portion of the developing unit storage portion to guide movement of the developing unit when the developing unit enters the developing unit storage portion to be accommodated therein.

The guide member may include a first guide rail to guide a lower end of the developing unit, and a second guide rail disposed on both sides of the first guide rail to guide both lateral surfaces of the developing unit.

The developing unit may include at least one second position determining protrusion protruding from the other end of the developing unit opposite to the one side in a direction in which the developing unit enters the developing unit storage portion.

The image forming apparatus may further include a rear frame disposed at a position opposite to the front frame with the guide member placed between the front frame and the rear frame, wherein the rear frame may include at least one second coupling hole formed at a position corresponding to the first position determining protrusion to be coupled to the at least one second position determining protrusion.

The image forming apparatus may further include a support member coupled to an inside of the rear frame, wherein the support member may include at least one guide hole formed at a position corresponding to the second coupling hole through the support member to allow the second position determining protrusion to be coupled to the second coupling hole therethrough.

The support member may include a first support to support the other side of the developing unit in a direction opposite to the direction in which the developing unit enters the developing unit storage portion, and a second support protruding from the first support into the body to support an upper end of the developing unit in a direction perpendicular to the direction in which the developing unit enters the developing unit storage portion.

The guide hole may be formed through the first support.

In accordance with another aspect of the present invention, an image forming apparatus may include a body, a developing unit disposed in the body, a first developing unit accommodating portion to accommodate the developing unit such that the developing unit is spaced apart from a path along which a recording medium is transported, and at least one second developing unit accommodating portion to accommodate the developing unit such that the developing unit forms at least one portion of the path along which the recording medium is transported.

The first developing unit accommodating portion and the second developing unit accommodating portion may be disposed parallel to each other in a first direction directed from a front of the body to a back thereof.

The developing unit may be arranged to be detachably accommodated in one of the first developing unit accommodating portion and the second developing unit accommodating portion in the first direction.

The first developing unit accommodating portion and the second developing unit accommodating portion may be disposed spaced apart from each other in a second direction perpendicular to the first direction.

The image forming apparatus may further include a toner unit to supply toner to the developing unit, and a toner unit accommodating portion to accommodate the toner unit, wherein the second developing unit accommodating portion may be disposed relatively closer to the toner unit accommodating portion, compared to the first developing unit accommodating portion.

The image forming apparatus may further include a front frame and a rear frame disposed spaced from each other in a front-back direction of the body, and a lower frame disposed between the front frame and the rear frame, wherein the lower frame may include a first guide member to guide movement of the developing unit when the developing unit enters the first developing unit accommodating portion to be accommodated therein, and a second guide member disposed to be spaced apart from the first guide member in the second direction and to guide movement of the developing unit when the developing unit enters the second developing unit accommodating portion to be accommodated therein.

The image forming apparatus may further include a support member coupled to an inner surface of the rear frame, wherein the support member may include a first support to support the developing unit in a direction opposite to the first direction, and a second support to support the developing unit in a third direction perpendicular to both the first direction and the second direction.

The support member may be formed of a material different from a material of the rear frame.

In accordance with a further aspect of the present invention, an image forming apparatus may include a body, a developing unit disposed in the body, a developing unit mounting portion to accommodate the developing unit to allow the developing unit to perform image formation, and a developing unit storage portion provided in the body to accommodate the developing unit, separately from the developing unit mounting portion.

In accordance with another aspect of the present invention, an image forming apparatus may include a body to enable selective storage of a developing unit in one of at least two locations within the body, one of locations within the body including a first storage which, when the developing is stored therein, forms a portion of a path along which a recording medium is transported.

One of the at least two locations within the body may include a second storage to store the developing unit, wherein the first storage and second storage are disposed on opposite sides of an optical scanning unit which emits light to form an electrostatic latent image on a photosensitive body of the developing unit. When the developing unit is disposed within the first storage the photosensitive body may be arranged to receive the light emitted from the optical scanning unit. When the developing unit is stored in the second storage, the developing unit may be disposed away from the recording medium path.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
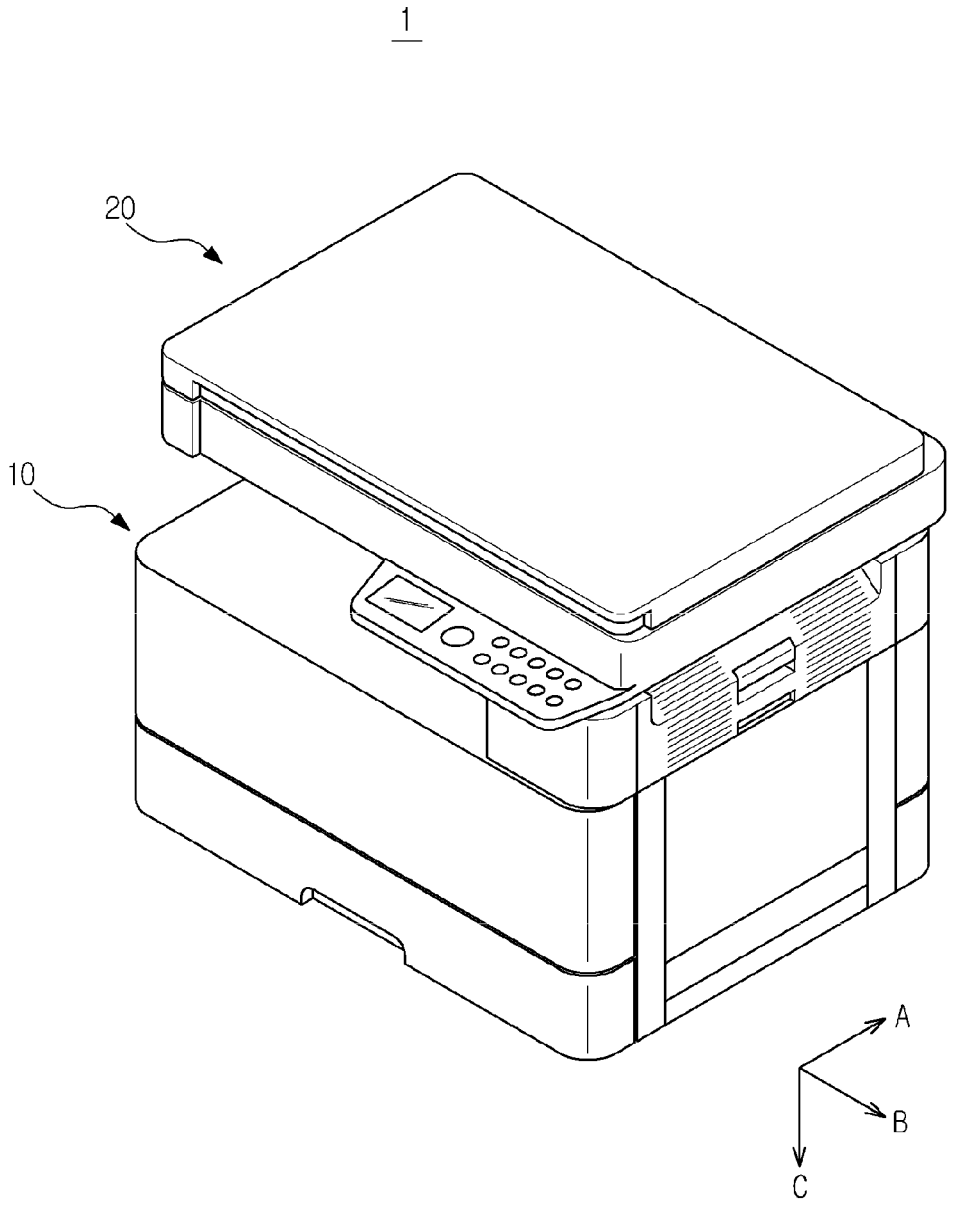
FIG. 1 is a perspective view showing an image forming apparatus according to an exemplary embodiment of the present invention.

Reference will now be made in detail to example embodiments of the present invention, examples of which are illustrated in the accompanying drawings, wherein like reference numerals refer to like elements throughout.

Figure 2:
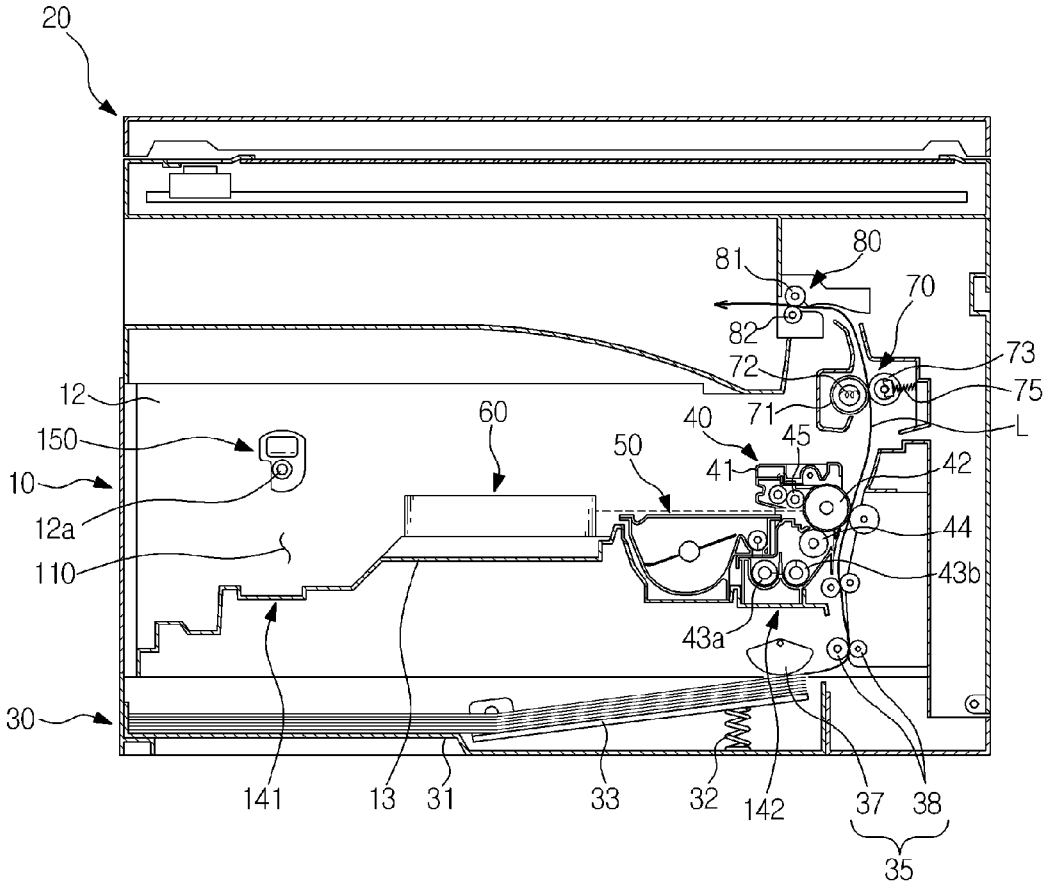
FIG. 2 is a view schematically showing the configuration of the image forming apparatus of FIG. 1, with a developing unit accommodated in a second developing unit accommodating portion.

FIG. 1 is a perspective view showing an image forming apparatus according to an exemplary embodiment of the present invention, and FIG. 2 is a view schematically showing an example configuration of the image forming apparatus of FIG. 1, with a developing unit accommodated in a second developing unit accommodating portion.

As shown in FIGS. 1 and 2, the image forming apparatus 1 may include a body 10, and a scanning unit 20 disposed at an upper portion of the body 10. The body 10 may include therein a feeder unit 30 to store and feed a printing medium P, a developing unit 40 to form an image on the printing medium P supplied through the feeder unit 30, a toner unit 50 to supply toner to the developing unit 40, an optical scanning unit 60 to form an electrostatic latent image on a photosensitive body 42 of the developing unit 40, a fusing unit 70 to fuse a toner image transferred to the printing medium P to the printing medium P, and a discharge unit 80 to discharge, from the body 10, the printing medium P upon which image formation has been completed. The printing medium P may include, for example, printing paper sheets such as glossy paper, plain paper, art paper, overhead projector film, and the like.

The feeder unit 30, which is provided to store and feed printing media P, may be disposed at the lower portion of the body 20 to supply the printing media P to the developing unit 40.

The feeder unit 30 may include a cassette-type feed tray 31 retractably placed in the body 10 to store printing media P, and a transport member 35 to pick up the printing media P stored in the feed tray 31 one by one and transport the same toward the developing unit 40.

A knock-up plate 33 may be provided in the feed tray 31. One end of the knock-up plate 33 may be rotatably coupled to the feed tray 31 and the other end thereof may be supported by a compression spring 32, such that the stacked printing media P are guided toward the transport member 35.

The transport member 35 may include a pick-up roller 37 to pick up the printing medium P stacked on the knock-up plate 33 one by one (i.e., one unit or sheet of the printing medium P at a time), and a feed roller 38 to transport a printing medium P picked up by the pick-up roller 37 toward the developing device 40.

The developing unit 40 may include a housing 41 forming an external appearance of the developing unit 40, a photosensitive body 42 rotatably coupled to the inside of the housing 41 to form an electrostatic latent image, churning screws 43*a* and 43*b* to churn the toner fed from the toner unit 50, a developing roller 44 to feed the toner churned by the churning screws 43*a* and 43*b* to the photosensitive body 42, and a charging member 45 to charge the photosensitive body 42.

By way of example, the toner fed from the toner unit 50 may be introduced into the housing 41, churned by the churning screws 43*a* and 43*b* and transported to one side of the housing 41. The churned and transported toner may be fed to the photosensitive body 42 by the developing roller 44 to form a visible image.

The toner unit 50 may be coupled to the developing device 40 and may be adapted to (or configured to, suitable for, operable to, capable of, etc.) accommodate and retain the toner to form an image on a printing medium P and to feed toner to the developing unit 40 as image formation proceeds.

The optical scanning unit 60 emits light including information about an image onto the photosensitive body 42 to form an electrostatic latent image on the photosensitive body 42.

The fusing unit 70 may apply heat and pressure to the printing medium P to fuse the image of a developing agent formed on the printing medium P to the printing medium P.

The fusing unit 70 may include a heating member 71 provided therein with a heat source 72, and a pressing roller 73 to press the heating member 71 toward the printing medium P.

The heat source 72 may be adapted with (or configured with, suitable for, operable with, capable of including, etc.) a heating element such as a heater, a heating lamp, and a hot wire.

The heating member 71 may be formed in the shape of a roller having a heat source 72 installed therein, or in the shape of a belt heated by the heat source 72.

The pressing roller 73 may be supported by an elastic member 75 such that the pressing roller 73 closely contacts the heating member 71 to maintain a constant fusing pressure between the pressing roller 73 and the heating member 71. A plurality of pressing rollers 73 may be provided, if necessary.

The fusing unit 70 may apply heat and pressure to a visible image transferred to the printing medium P while the printing medium P passes through the heating member 71 and the pressing member 73. Thereby, the visible image may be fused to the printing medium P.

The discharge unit 80 may include a first discharge roller 81 and a second discharge roller 83, which are sequentially installed. The discharge unit 80 discharges, from the body 10, the printing medium P having passed through the fusing unit 70.

Hereinafter, a first direction may be defined as the direction indicated by arrow A, directed from the front of the body to the back thereof. A second direction may be defined as the direction indicated by arrow B, perpendicular to the first direction and directed from the left side of the body to the right side thereof. A third direction may be defined as the direction indicated by arrow C, perpendicular to the first and second directions and directed from the upper portion of the body to the lower portion thereof.

Figure 3:
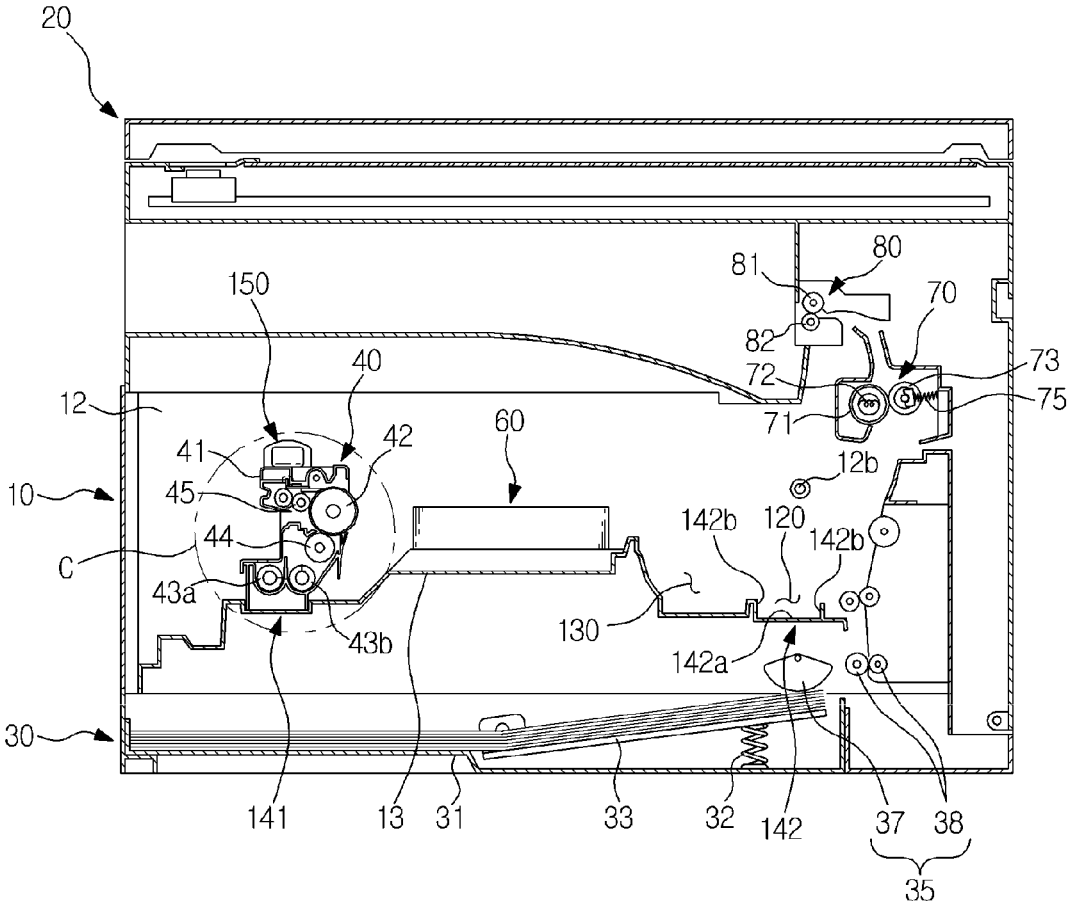
FIG. 3 is view showing the developing unit accommodated in a first developing unit accommodating portion.
Figure 4:
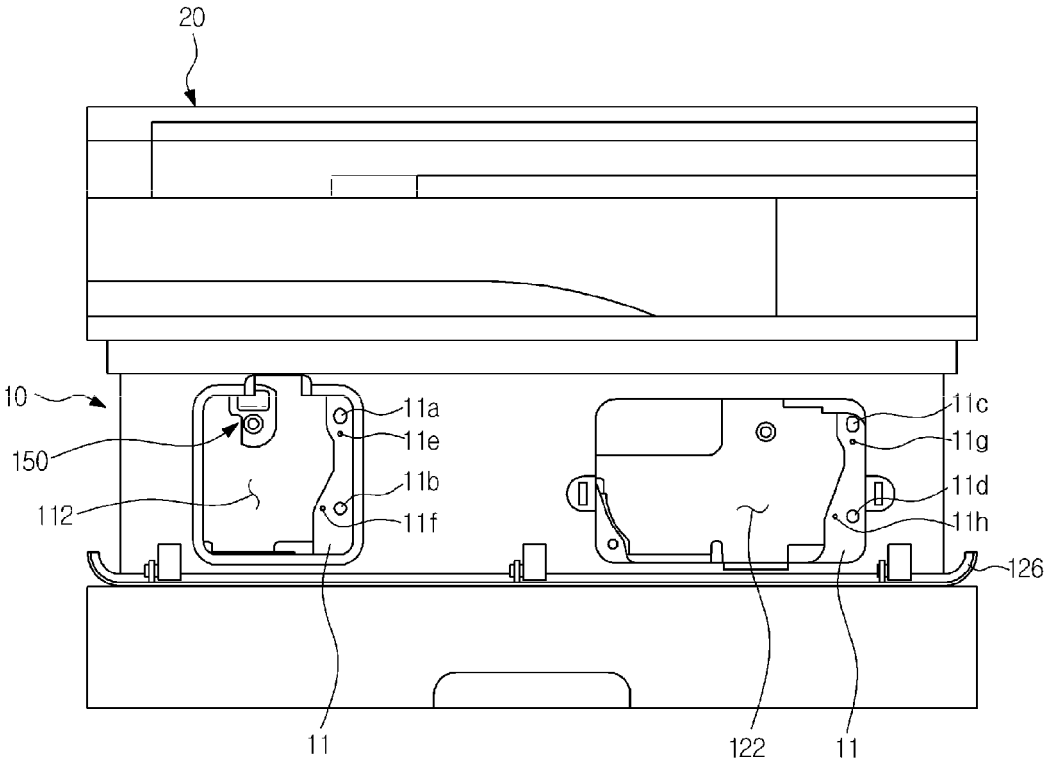
FIG. 4 is a view showing the front surface of a body of the image forming apparatus, with a first opening and a second opening opened.
Figure 5:
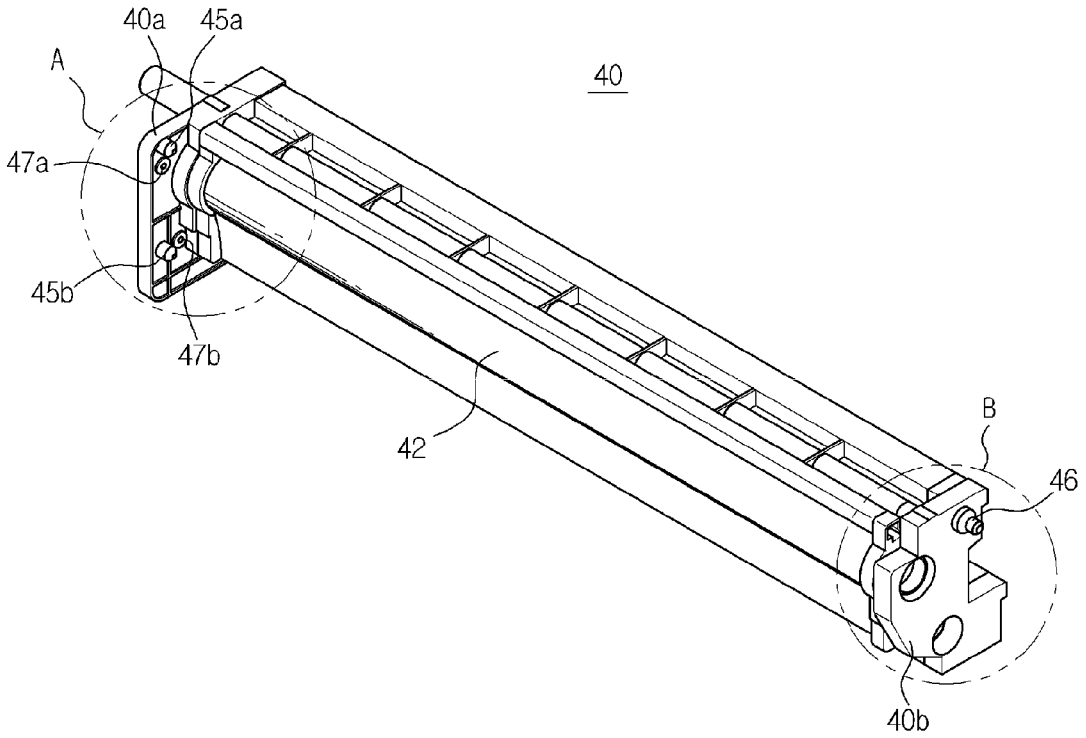
FIG. 5 is a perspective view showing the developing unit.
Figure 6:
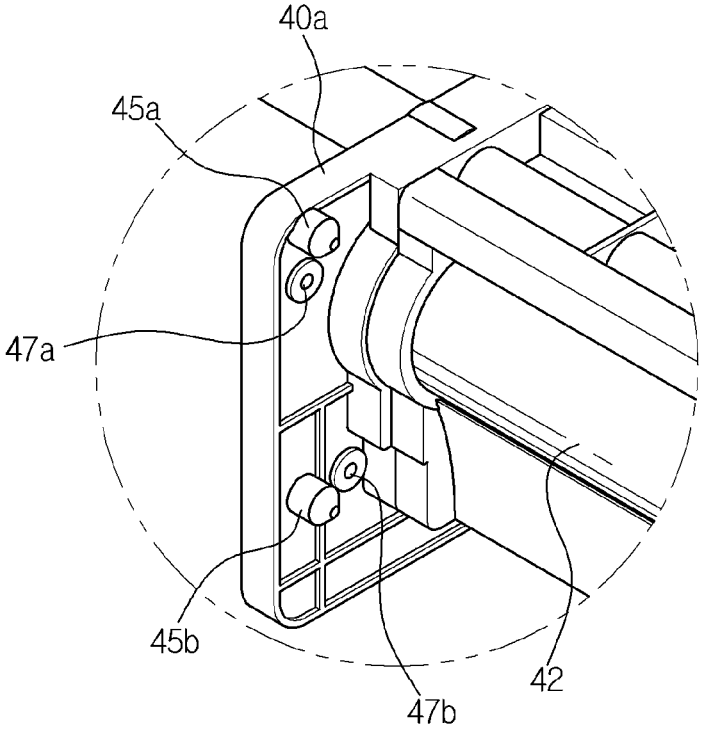
FIG. 6 is an enlarged view of portion A shown in FIG. 5.
Figure 7:
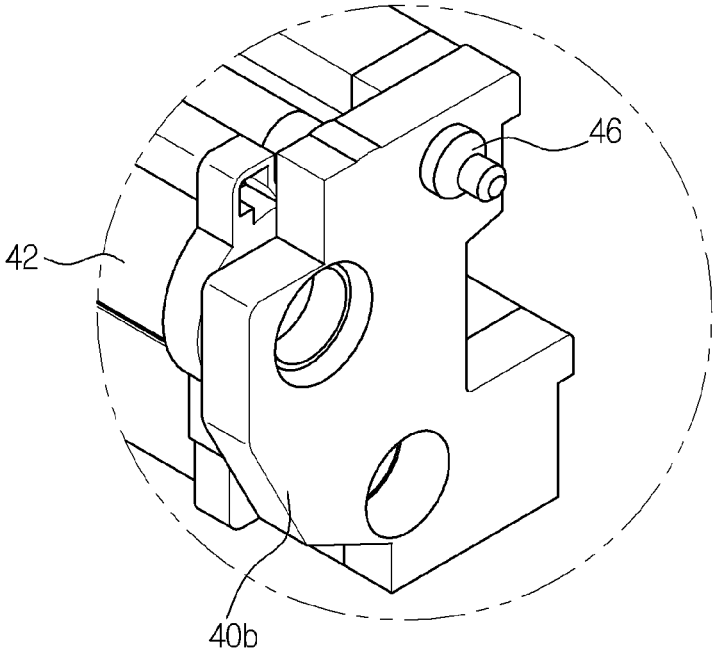
FIG. 7 is an enlarged view of portion B shown in FIG. 5.

FIG. 3 illustrates a view showing the developing unit accommodated in a first developing unit accommodating portion, and FIG. 4 illustrates a view showing the front surface of a body of the image forming apparatus, with a first opening and a second opening opened. FIG. 5 is a perspective view showing the developing unit, FIG. 6 is an enlarged view of portion A shown in FIG. 5, and FIG. 7 is an enlarged view of portion B shown in FIG. 5.

As shown in FIGS. 1 to 7, a developing unit storage portion 110 and a developing unit mounting portion 120 may be provided at different positions in the body 10. Hereinafter, the developing unit storage portion 110 may be referred to as or defined as a first developing unit accommodating portion 110, and the developing unit mounting portion 120 may be referred to as or defined as the second developing unit accommodating portion 120.

The first developing unit accommodating portion 110 and the second developing unit accommodating portion 120 may be formed to extend in a direction directed from the front of the body 10 to the back thereof, i.e., the first direction, and may be arranged parallel to each other in the second direction perpendicular to the first direction. The first developing unit accommodating portion 110 and the second developing unit accommodating portion 120 may be positioned at both sides of the optical scanning unit 60, with the optical scanning unit 60 placed therebetween. For example, for a user or person observing the image forming apparatus by facing the front of the image forming apparatus, the first developing unit accommodating portion 110 may be to the left of the optical scanning unit 60, while the second developing unit accommodating portion 120 may be to the right of the optical scanning unit 60. However, the disclosure is not so limited and other configurations are possible. For example, the first developing unit accommodating portion 110 and the second developing unit accommodating portion 120 may be arranged in the rear of the image forming apparatus.

The position of the second developing unit accommodating portion 120 may be closer to the path L along which a recording or printing medium P is transported than the position of the first developing unit accommodating portion 110. The path L along which the recording medium P is transported may refer to the path along which the recording medium P accommodated in the feed tray 31 is transported along the pick-up roller 37, feed roller 38, photosensitive body 42, heating member 71 and pressing roller 73, first discharge roller 81, and second discharge roller 83.

In addition, the position of the second developing unit accommodating portion 120 may be closer to a toner unit accommodating portion 130 which accommodates the toner unit 50 than the position of the first developing unit accommodating portion 110.

The developing unit 40 may be detachably accommodated in one of the first developing unit accommodating portion 110 and the second developing unit accommodating portion 120 in the first direction.

When accommodated in the first developing unit accommodating portion 110, the developing unit 40 may be disposed to be spaced apart from the path L along which the recording medium P is transported. When accommodated in the second developing unit accommodating portion 120, the developing unit 40 may be disposed to form at least one portion of the path L along which the recording medium P is transported. That is, the developing unit 40 is not allowed to perform image formation when accommodated in the first developing unit accommodating portion 110, while it is allowed to perform image formation when accommodated in the second developing unit accommodating portion 120. When the developing unit 40 is accommodated in the second developing unit accommodating portion 120, the photosensitive body 42 of the developing unit 40 forms at least one portion of the path L along which the recording medium P is transported, and is disposed and allowed to form an electrostatic latent image on the transported recording medium P.

Through a first opening 112 provided on the front surface of the body 10, the developing unit 40 may enter the first developing unit accommodating portion 110, or be separated from the first developing unit accommodating portion 110. Through a second opening 122 provided on the front surface of the body 10, the developing unit 40 may enter the second developing unit accommodating portion 120, or be separated from the second developing unit accommodating portion 120. The first opening 112 and the second opening 122 may be formed through the front frame 11.

Figure 10A:
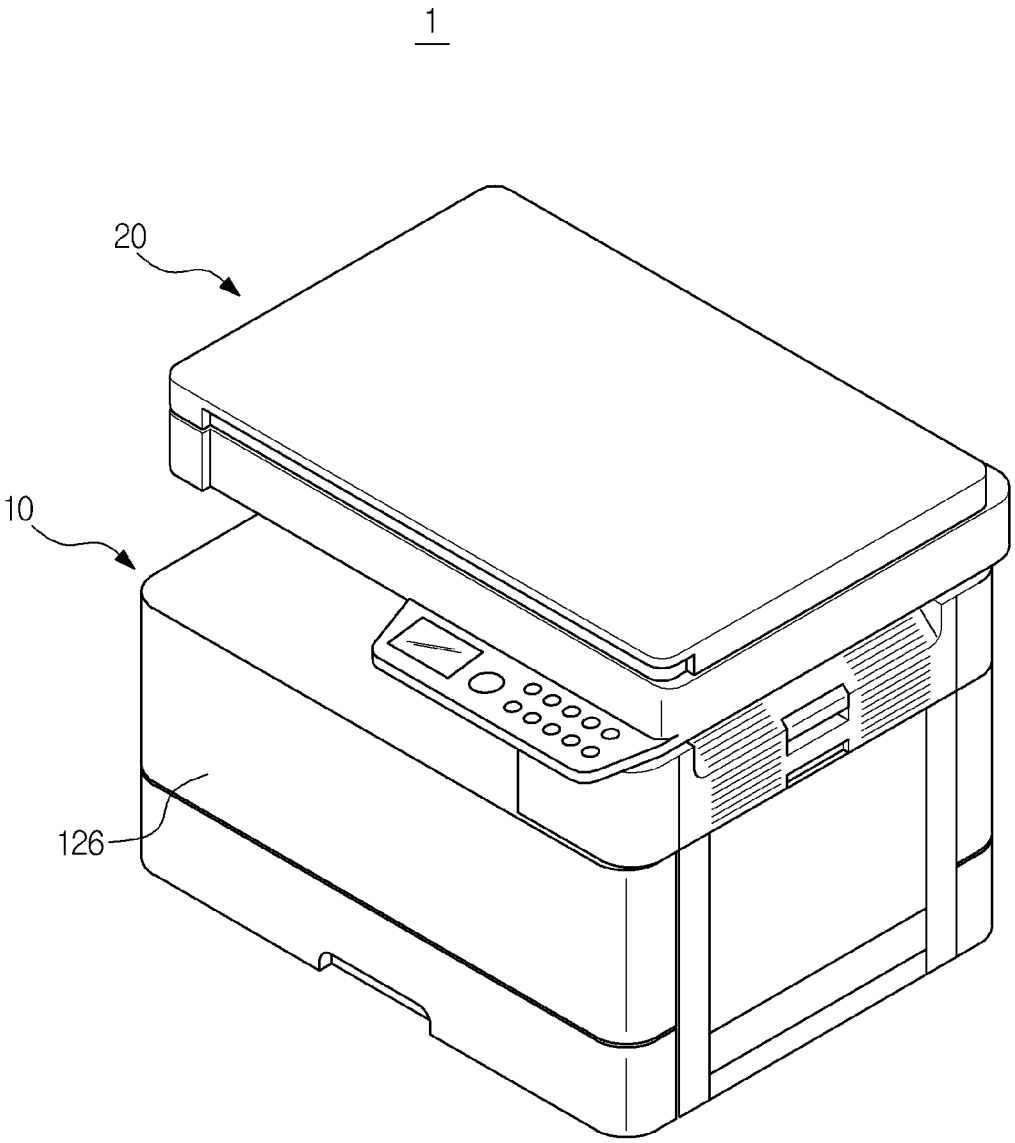
FIGS. 10A to 10F are views illustrating a process in which the developing unit is removed from the first developing unit accommodating portion and mounted to the second developing unit accommodating portion.
Figure 10B:
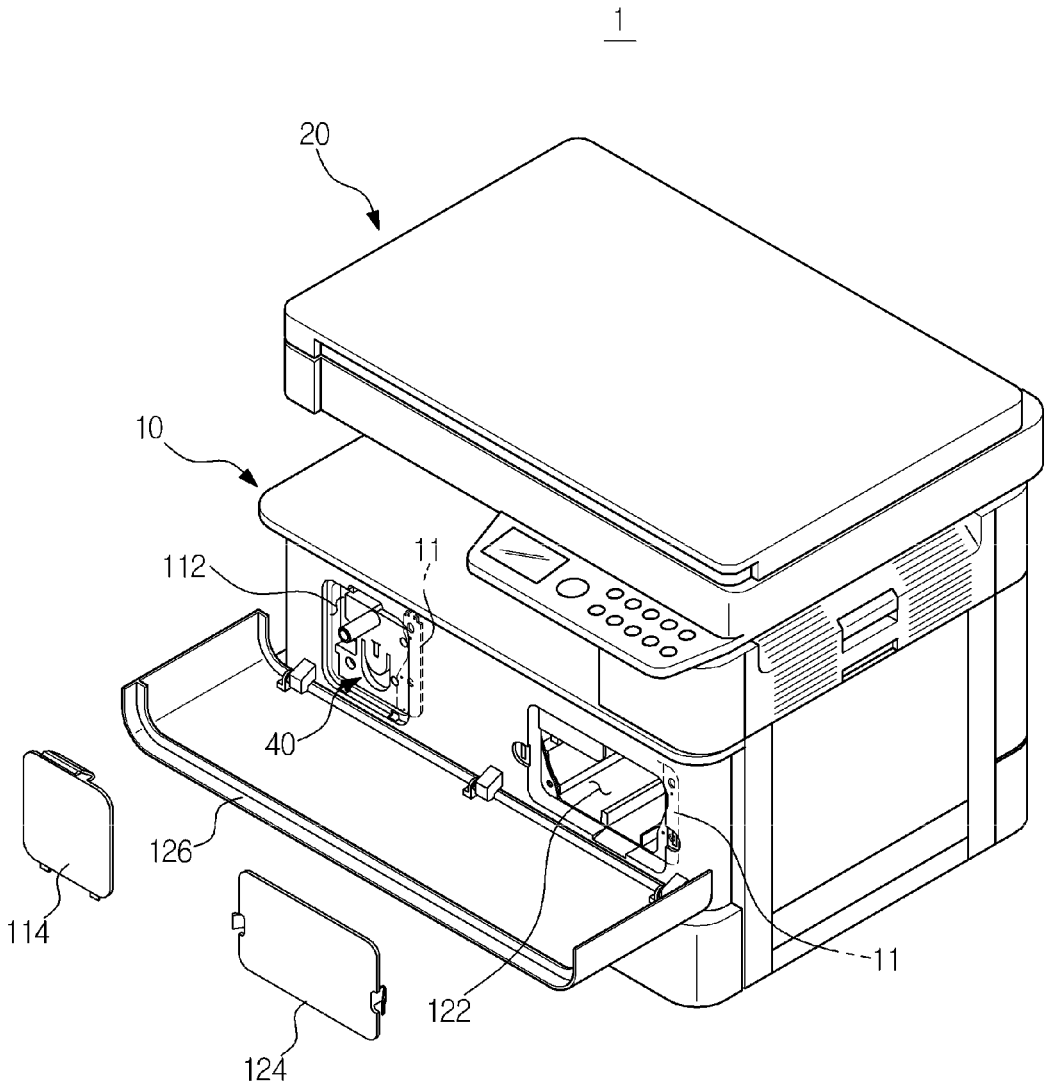
Figure 10C:
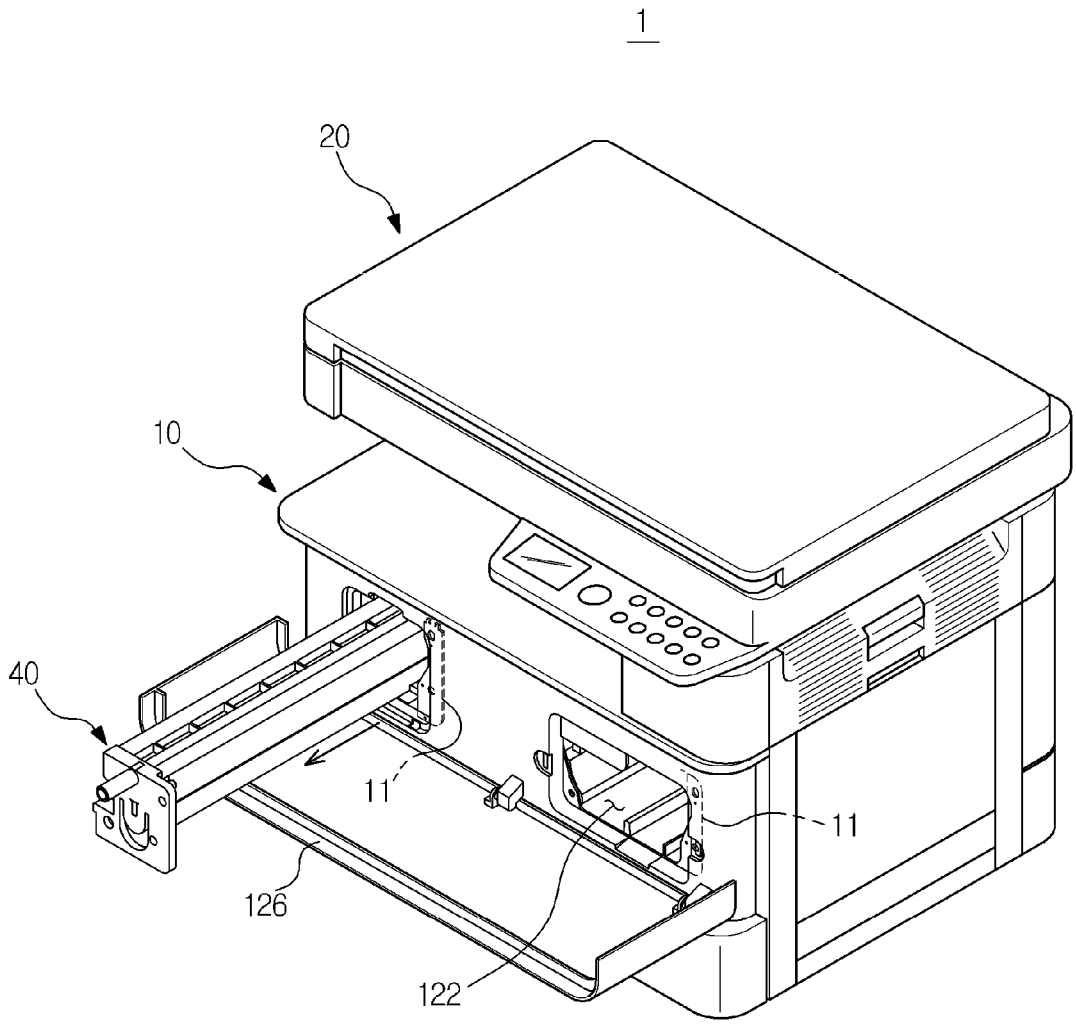

The first opening 112 and the second opening 122 may be respectively opened or closed by a first cover 114 (see FIG. 10B) and a second cover 124 (see FIG. 10B). When the first cover 114 and the second cover 124 are covered by a third cover 126 forming an external appearance of the image forming apparatus 1, they are not exposed outside of the image forming apparatus 1.

Provided in the body 10 are the front frame 11 and a rear frame 12 spaced from each other in the front-back direction of the body 10, and a lower frame 13 disposed between the front frame 11 and the rear frame 12. The front frame 11, the rear frame 12, and/or the lower frame 13 may be formed of a metallic material.

The front frame 11 may include a plurality of first coupling holes 11*a*, 11*b*, 11*c* and 11*d* to determine a position of the developing unit 40 accommodated in the first developing unit accommodating portion 110 or the second developing unit accommodating portion 120, and a plurality of second fixing holes 11*e*, 11*f*, 11*g* and 11*h* to fix the developing unit 40 once the position of the developing unit 40 accommodated in the first developing unit accommodating portion 110 or the second developing unit accommodating portion 120 is determined. The first coupling holes 11*a*, 11*b*, 11*c* and 11*d* and the second fixing holes 11*e*, 11*f*, 11*g* and 11*h* may be formed at positions adjacent to the first opening 112 and the second opening 122 through the front frame 11. As shown in FIG. 4, for example, coupling holes 11*a* and 11*c* may be disposed on the frame 11 above second fixing holes 11*e* and 11*g*, respectively. Further, coupling holes 11*b* and 11*d* may be disposed on the frame 11 below coupling holes 11*a* and 11*c*, respectively, and may also be disposed at a first side (e.g., to the left or in the second direction) of second fixing holes 11*f* and 11*h*, respectively.

The rear frame 12 may include a plurality of second coupling holes 12*a* and 12*b* to determine the position of the developing unit 40 accommodated in the first developing unit accommodating portion 110 or the second developing unit accommodating portion 120. The second coupling holes 12*a* and 12*b* may be formed through the rear frame 12.

As shown in FIG. 5 and FIG. 6, for example, a developing unit 40 may include a plurality of first position determining protrusions 45*a* and 45*b* protruding from one side 40*a* of the developing unit 40 in a direction in which the developing unit 40 enters the first developing unit accommodating portion 110 or the second developing unit accommodating portion 120, i.e., in the first direction. As shown in FIG. 5 and FIG. 7, for example, at least one second position determining protrusion 46 protruding from the other side 40*b* opposite to the one side 40*a* in a direction in which the developing unit 40 enters the first developing unit accommodating portion 110 or the second developing unit accommodating portion 120, i.e., in the first direction. The developing unit 40 may also include a plurality of first fixing holes 47*a* and 47*b* formed through the one side 40*a*.

When the developing unit 40 is accommodated in the first developing unit accommodating portion 110, the first position determining protrusions 45*a* and 45*b* may be disposed at positions corresponding to the first coupling holes 11*a* and 11*b*, and coupled to the first coupling holes 11*a* and 11*b* to allow the developing unit 40 to be placed at a certain position in the first developing unit accommodating portion 110. When the developing unit 40 is accommodated in the second developing unit accommodating portion 120, the first position determining protrusions 45*a* and 45*b* may be arranged at positions corresponding to the first coupling holes 11*c* and 11*d*, and coupled to the first coupling holes 11*c* and 11*d* to allow the developing unit 40 to be placed at a certain position in the second developing unit accommodating portion 120.

When the developing unit 40 is accommodated in the first developing unit accommodating portion 110, the second position determining protrusion 46 may be disposed at a position corresponding to the second coupling hole 12*a*, and coupled to the second coupling hole 12*a* to allow, in cooperation with the first position determining protrusions 45*a* and 45*b*, the developing unit 40 to be disposed at a certain position in the first developing unit accommodating portion 110. When the developing unit 40 is accommodated in the second developing unit accommodating portion 120, the second position determining protrusion 46 may be arranged at a position corresponding to the second coupling hole 12*b*, and coupled to the second coupling hole 12*b* to allow, in cooperation with the first position determining protrusions 45*a* and 45*b*, the developing unit 40 to be disposed at a certain position in the second developing unit accommodating portion 120.

The first fixing holes 47*a* and 47*b* may be disposed at positions corresponding to the second fixing holes 11*e* and 11*f*, with the first position determining protrusions 45*a* and 45*b* and the second position determining protrusion 46 respectively coupled to the first coupling holes 11*a* and 11*b* and the second coupling hole 12*a*, i.e., with the developing unit 40 disposed at a certain position in the first developing unit accommodating portion 110. An operator may allow the developing unit 40 to be fixed to the first developing unit accommodating portion 110 by putting screws (not shown) into the first fixing holes 47*a* and 47*b* and the second fixing holes 11*e* and 11*f* to be coupled thereto.

In addition, the first fixing holes 47*a* and 47*b* may be disposed at positions corresponding to the second fixing holes 11*g* and 11*h*, with the first position determining protrusions 45*a* and 45*b* and the second position determining protrusion 46 coupled respectively to the first coupling holes 11*c* and 11*d* and the second coupling hole 12*b*, i.e., with the developing unit 40 disposed at a certain position in the second developing unit accommodating portion 120. The operator may allow the developing unit 40 to be fixed to the second developing unit accommodating portion 120 by putting screws (not shown) into the first fixing holes 47*a* and 47*b* and the second fixing holes 11*e* and 11*f* to be coupled thereto.

Figure 8:
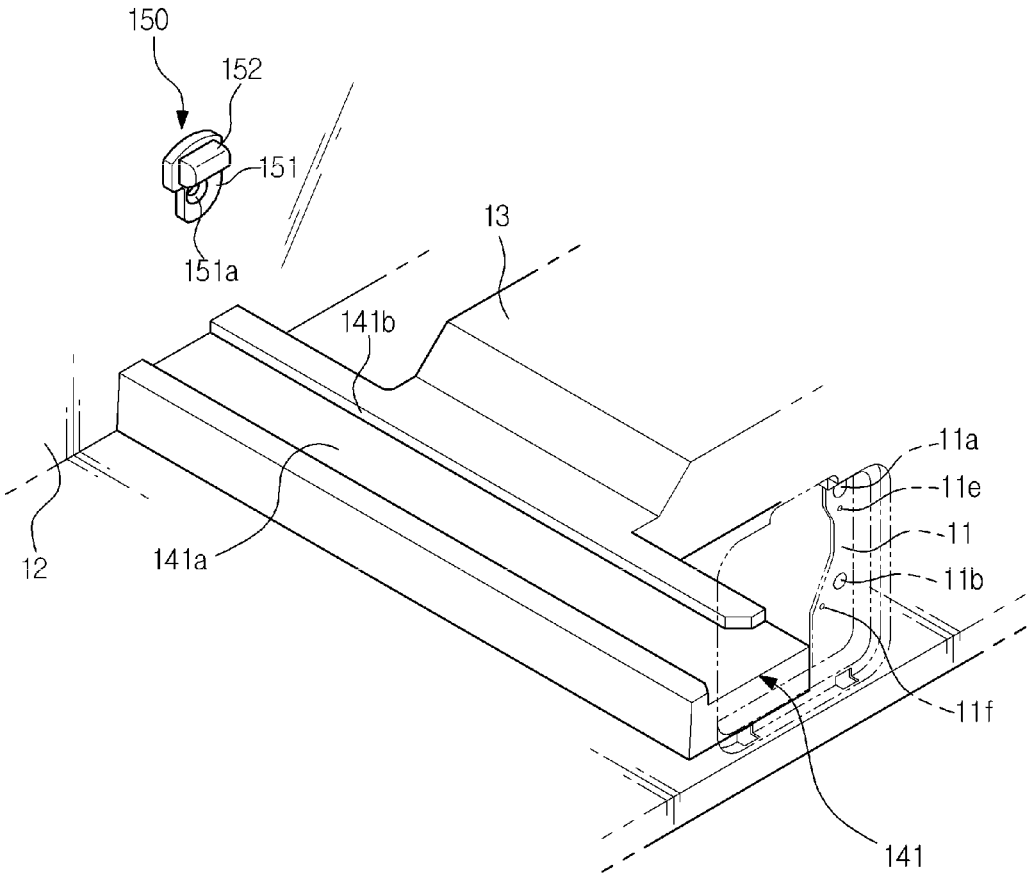
FIG. 8 is a view showing a first guide member and a support member.
Figure 9:
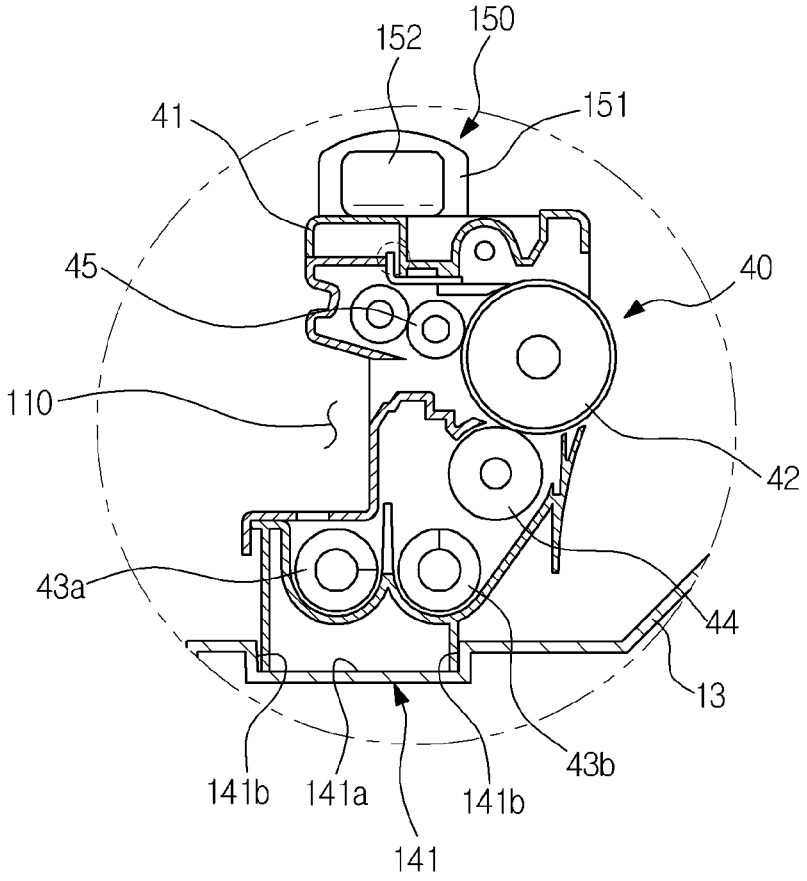
FIG. 9 is an enlarged view showing portion C in FIG. 3.

FIG. 8 is a view showing a first guide member and a support member, and FIG. 9 is an enlarged view showing portion C in FIG. 3.

As shown in FIGS. 8 and 9, the lower frame 13 may be provided with a first guide member 141 to guide movement of the developing unit 40 during accommodation of the developing unit 40 in the first developing unit accommodating portion 110, and a second guide member 142 to guide movement of the developing unit 40 during accommodation of the developing unit 40 in the second developing unit accommodating portion 120. The first guide member 141 and the second guide member 142 are formed to extend in the front-back direction of the body 10, and are spaced from each other in the second direction with the optical scanning unit 60 placed therebetween.

The first guide member 141 may include a first guide rail 141*a* to guide a lower end of the developing unit 40, and a second guide rail 141*b* disposed at both sides of the first guide rail 141*a* to guide both lateral surfaces of the developing unit 40. The first guide rail 141*a* may regulate shaking of the developing unit 40 in the vertical direction of the body 10 (the third direction and the direction opposite to the third direction) while the developing unit 40 is being accommodated in the first developing unit accommodating portion 110 or when the developing unit 40 is in the first developing unit accommodating portion 110. The second guide rail 141*b* may regulate shaking of the developing unit 40 in the lateral direction of the body 10 (the second direction and the direction opposite to the second direction) while the developing unit 40 is being accommodated in the first developing unit accommodating portion 110 or when the developing unit 40 is in the first developing unit accommodating portion 110.

The second guide member 142 may include a third guide rail 142*a* to guide the lower end of the developing unit 40, and a fourth guide rail 142*b* disposed at both sides of the third guide rail 142*a* to guide both lateral surfaces of the developing unit 40. The third guide rail 142*a* may regulate shaking of the developing unit 40 in the vertical direction of the body 10 (the third direction and the direction opposite to the third direction) while the developing unit 40 is being accommodated in the second developing unit accommodating portion 120 or when the developing unit 40 is in the second developing unit accommodating portion 120. The fourth guide rail 142*b* may regulate shaking of the developing unit 40 in the lateral direction of the body 10 (the second direction and the direction opposite to the second direction) while the developing unit 40 is being accommodated in the second developing unit accommodating portion 120 or when the developing unit 40 is in the second developing unit accommodating portion 120.

A support member 150 to support the developing unit 40 may be coupled to the inside of the rear frame 12.

The support member 150 may include a first support 151 to support the other side 40*b* of the developing unit 40 in the direction opposite to the direction in which the developing unit 40 is mounted to the first developing unit accommodating portion 110 (i.e., the direction opposite to the first direction), and a second support 152 protruding from the first support 151 into the body 10 to support the upper end of the developing unit 40 in a direction perpendicular to the direction in which the developing unit 40 is mounted in the first developing unit accommodating portion 110 (i.e., the third direction).

The first support 151 may include at least one guide hole 151*a* formed through the first support 151 at a position corresponding to the second coupling hole 12*a* to allow the second position determining protrusion 46 to be coupled to the second coupling hole 12*a* therethrough.

The support member 150 may be formed of plastic or rubber to damp shock applied to the developing unit 40 when shaking occurs in the developing unit 40 accommodated and fixed in the first developing unit accommodating portion 110.

Hereinafter, a description will be given of an example operation of separating the developing unit 40 from the first developing unit accommodating portion 110 and mounting the developing unit 40 in the second developing unit accommodating portion 120.

FIGS. 10A to 10F are views illustrating a process in which the developing unit is removed from the first developing unit accommodating portion and mounted to the second developing unit accommodating portion.

As shown in FIGS. 10A and 10B, the third cover 126 may be first rotated to expose the first cover 114 and the second cover 124 to the outside. For example, the third cover 126 may be rotated in a downward direction using hinges disposed on a bottom portion of the third cover 126. However, the disclosure is not so limited. For example, the third cover 126 may be rotated in left-to-right or right-to-left direction, using hinges disposed on a right or left side of the third cover 126. Then, the first cover 114 and the second cover 124 may be separated from the outer surface of the body 10 such that the first opening 112 and the second opening 122 are opened and exposed. The first cover 114 and second cover 124 may be attached to the outer surface of the body 10 using a clip, fastening members, and the like, for example.

Next, as shown in FIG. 100, screws (not shown) coupled to the first fixing holes 47*a* and 47*b* and the second fixing holes 11*e* and 11*f* may be removed to put the developing unit 40 in a movable state. Then, the developing unit 40 accommodated in the first developing unit accommodating portion 110 may be taken out of the first developing unit accommodating portion 110 through the opened first opening 112. At this time, the first position determining protrusions 45*a* and 45*b* are separated from the first coupling holes 11*a* and 11*b*.

Figure 10D:
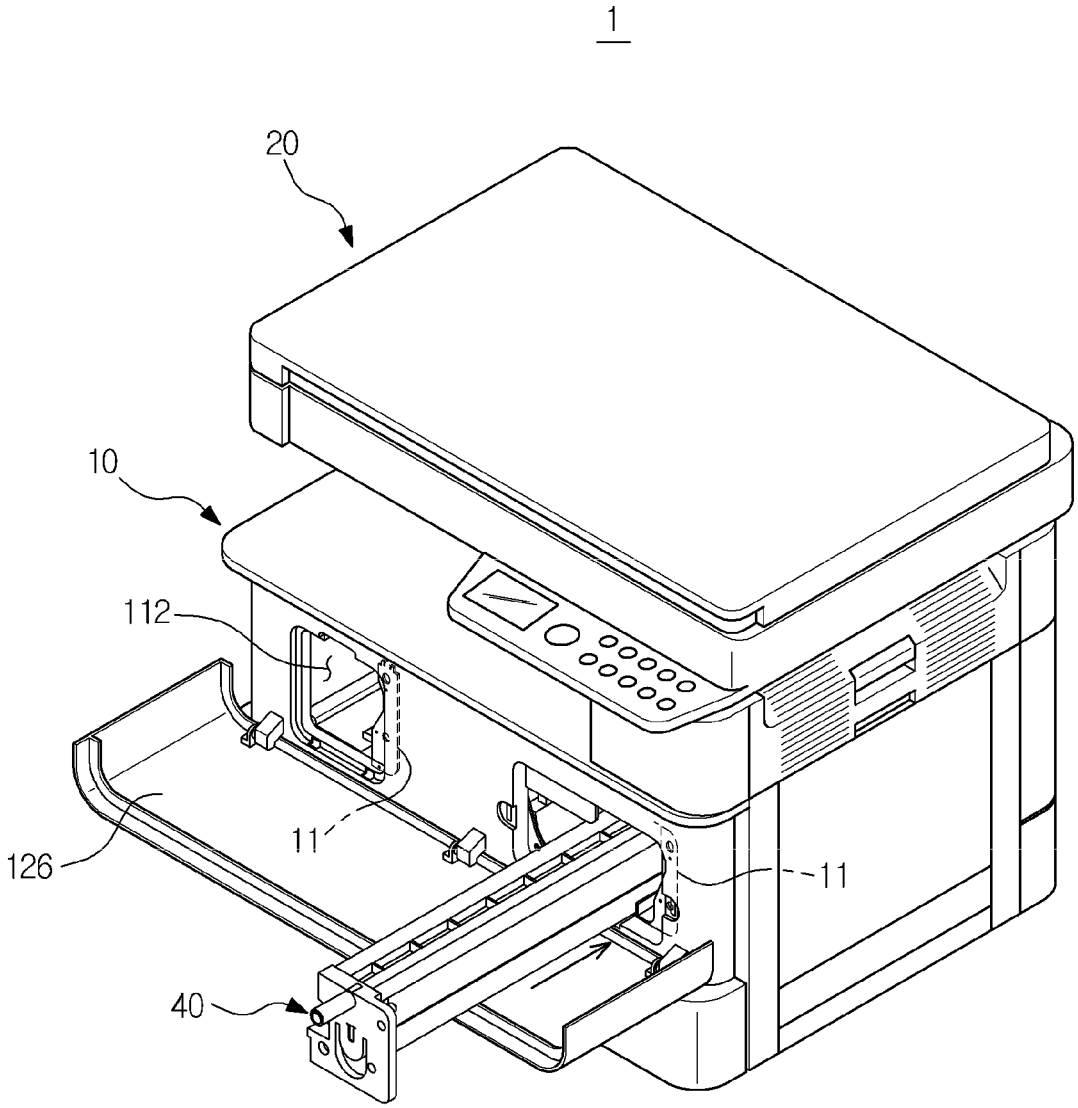

Next, as shown in FIG. 10D, the developing unit 40, having been completely removed from the first developing unit accommodating portion 110, may be pushed into the second developing unit accommodating portion 120 through the second opening 122 such that the first position determining protrusions 45*a* and 45*b* are coupled to the first coupling holes 11*c* and 11*d*. Then, screws (not shown) may be put into and coupled to the first fixing holes 47*a* and 47*b* and the second fixing holes 11*g* and 11*h* to fix the developing unit 40 to the second developing unit accommodating portion 120.

Figure 10E:
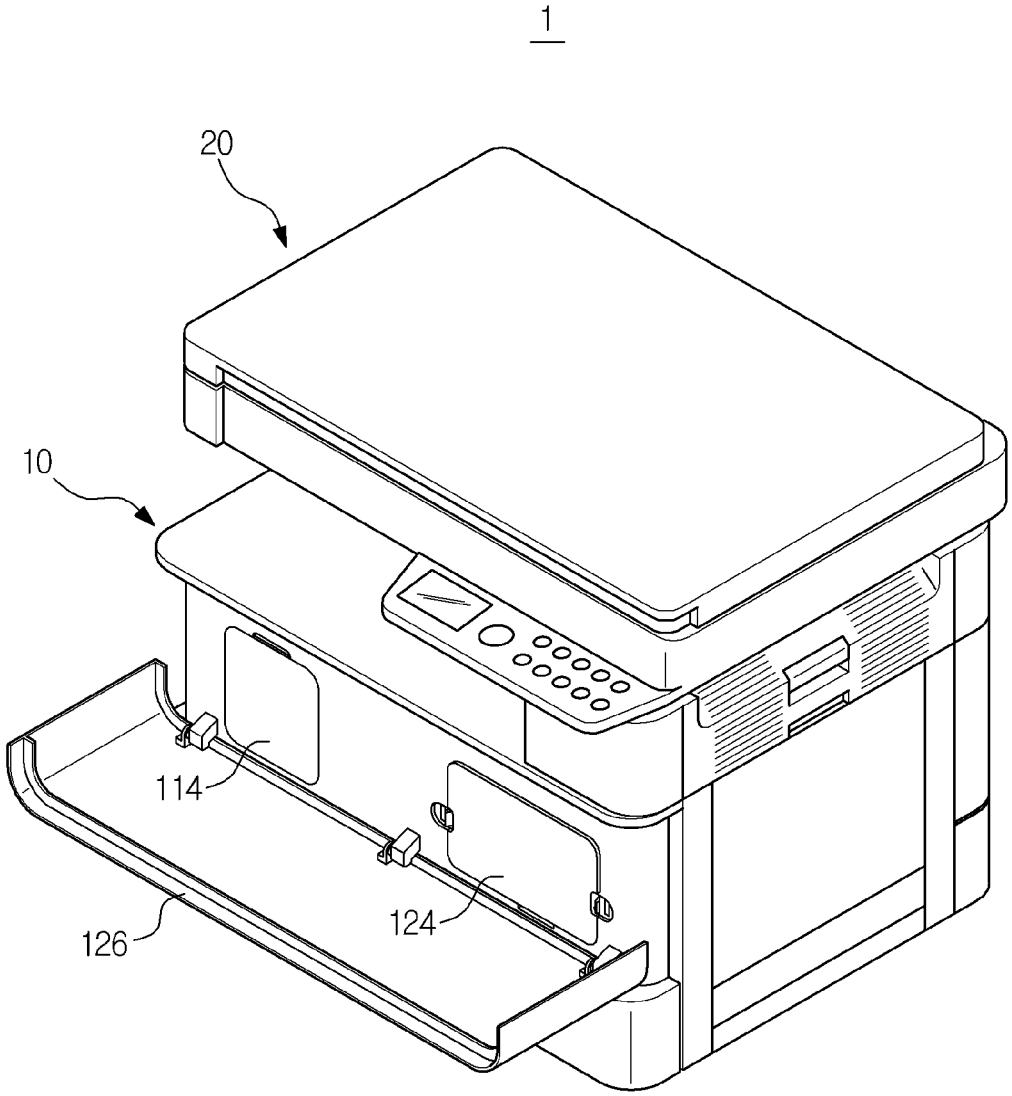

Next, as shown in FIG. 10E, the first cover 114 and the second cover 124 are coupled to the outer surface of the body 10 to close the first opening 112 and the second opening 122.

Figure 10F:
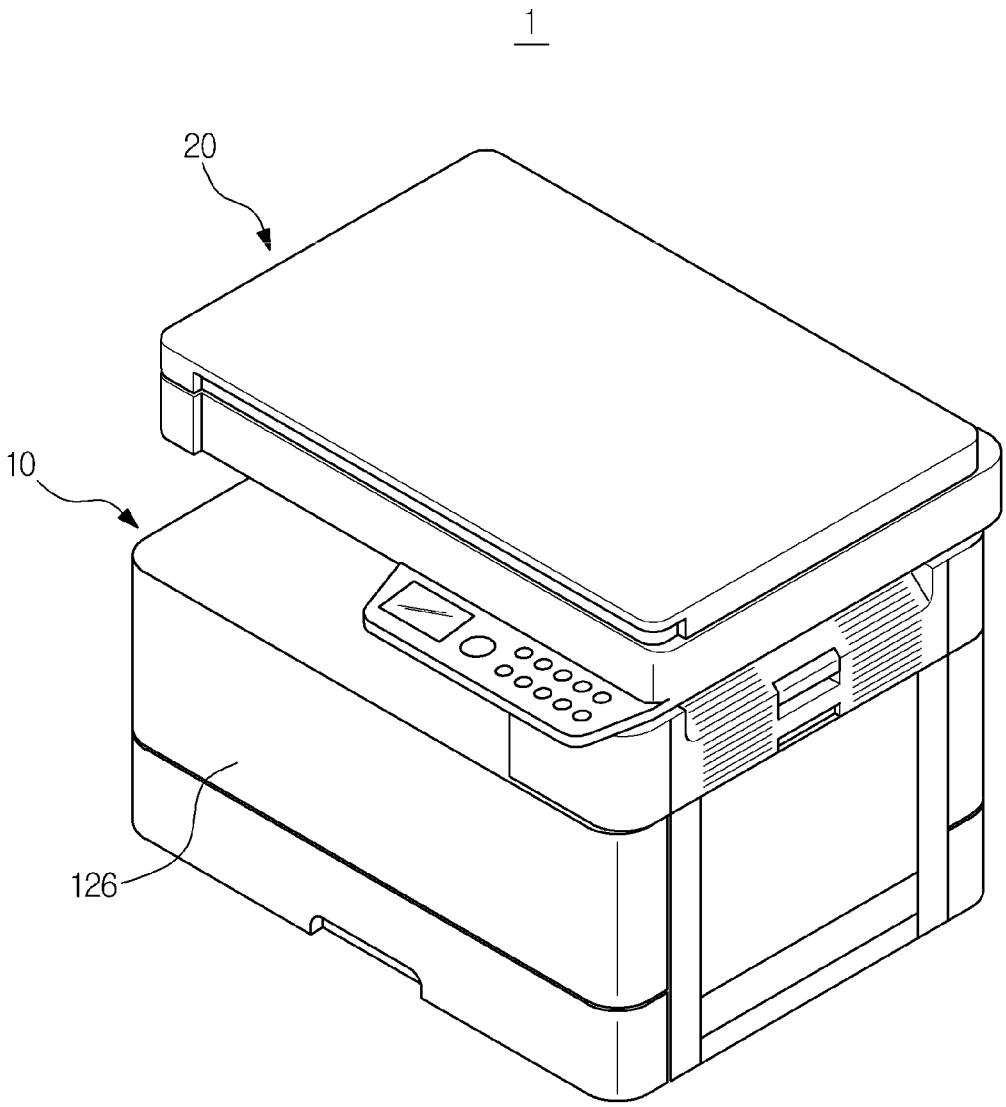

Lastly, as shown in FIG. 10F, the third cover 126 may be closed by rotating the third cover 126 such that the first cover 114 and the second cover 124 are not visible from the outside, and mounting of the developing unit 40 to the second developing unit accommodating portion 120 is completed.

When the developing unit 40 does not need to perform image formation (for example, during transportation of the developing unit 40 along with the body 10 of the image forming apparatus 1), the developing unit 40 may be accommodated in a separate space in the body 10 such as the first developing unit accommodating portion 110. Thereby, a separate expense for packing of the developing unit may not be incurred.

In addition, when the developing unit 40 is accommodated in the first developing unit accommodating portion 110, the developing unit 40 is disposed not to contact other components in the body 10. Further, the first guide member 141 and the support member 150 are provided to the first developing unit accommodating portion 110 to support the developing unit 40 accommodated in the first developing unit accommodating portion 110. Thereby, during transportation of the developing unit 40, the developing unit 40 may be stably stored without damage to the developing unit 40 due to shock.

As is apparent from the above description, separate from the position of a developing unit in a body at which the developing unit is mounted to perform image formation, a space to accommodate and store the developing unit is provided in the body. Thereby, a separate expense for packing of the developing unit may not be incurred, and the developing unit may be stably stored.

The image forming apparatus may use one or more processors. For example, a processing device may be implemented using one or more general-purpose or special purpose computers, such as, for example, a processor, a controller and an arithmetic logic unit, a central processing unit (CPU), a graphics processing unit (GPU), a digital signal processor (DSP), a microcomputer, a field programmable array, a programmable logic unit, an application-specific integrated circuit (ASIC), a microprocessor or any other device capable of responding to and executing instructions in a defined manner.

In accordance with the above-described example embodiments, the image forming apparatus includes a first developing unit accommodating portion and a second developing unit accommodating portion, each of which accommodate the developing unit, and at least one of the first developing unit accommodating portion and second developing unit accommodating portion is disposed such that when the developing unit is stored therein, the developing unit is disposed along a recording medium path and an image forming process may be performed. Further, the first developing unit accommodating portion and second developing unit accommodating portion may be arranged parallel with one another in the first direction (i.e., a front-to-back direction of the printer). However, the disclosure is not so limited. The first developing unit accommodating portion and second developing unit accommodating portion may be differently arranged, so long as at least one of the first developing unit accommodating portion and second developing unit accommodating portion is disposed such that when the developing unit is stored therein, the developing unit is disposed along a recording medium path and an image forming process may be performed. Further, the first developing unit accommodating portion and second developing unit accommodating portion may not be arranged parallel with one another, or may be arranged parallel with one another in a different direction. It is further appreciated that two developing units could be stored in the image forming apparatus (one in each of the first developing unit accommodating portion and second developing unit accommodating portion), and that an image forming process could be performed while one of the developing units is disposed in the first developing unit accommodating portion and the other developing unit is disposed in the second developing unit accommodating portion, if desired. Alternatively, the image forming apparatus may be prevented from performing an image forming process if a developing unit is stored in the first developing unit accommodating portion (e.g., based upon a sensor detection or indication, switch, and the like).

One of ordinary skill in the art would understand that the above-disclosed image forming apparatus may include a printer, a copy machine, a facsimile machine, or a multifunctional device which incorporates two or more of the functionalities of the printer, the copy machine, and the facsimile (which may be referred to as a multifunctional peripheral device or MFP). Additionally, the image forming apparatus may have the capability for single-sided printing and/or duplex printing, and is not limited to the example embodiment of the image forming apparatus shown in FIG. 1.

Although example embodiments of the present invention have been shown and described, it would be appreciated by those skilled in the art that changes may be made to these embodiments without departing from the principles and spirit of the invention, the scope of which is defined in the claims and their equivalents.

What is claimed is:

1. An image forming apparatus, comprising:

a body;

a feeder unit to feed a recording medium;

a discharging unit to discharge the recording medium out of the body onto a recording medium support part;

a developing unit mounting portion to accommodate a developing unit when the developing unit is used to perform image formation; and a developing unit storage portion enclosed within an interior of the body to accommodate the developing unit, separately from the developing unit mounting portion and spaced apart from a path along which the recording medium is transported from the feeder unit to the discharging unit, such that the developing unit is unable to perform image formation while accommodated in the developing unit storage portion, wherein the developing unit comprises a photosensitive body to form an electrostatic latent image to be transferred to a transfer roller of the image forming apparatus disposed adjacent to the photosensitive body, and a developing roller to supply toner to the photosensitive body, and the developing unit storage portion is disposed above the feeder unit and below the recording medium support part, wherein the developing unit is selectively accommodated in one of the developing unit mounting portion and the developing unit storage portion, and the photosensitive body of the developing unit is not disposed adjacent to any transfer roller of the image forming apparatus while the developing unit is accommodated in the developing unit storage portion.

2. The image forming apparatus according to claim 1, wherein an optical scanning unit is disposed between the developing unit storage portion and the developing unit mounting portion.

3. The image forming apparatus according to claim 1, wherein, when the developing unit is accommodated and disposed in the developing unit mounting portion, the photosensitive body forms at least one portion of the path along which a recording medium is transported.

4. The image forming apparatus according to claim 1, further comprising:

a first opening provided on a front surface of the body to allow the developing unit to enter the developing unit storage portion; and a second opening provided on the front surface of the body to allow the developing unit to enter the developing unit mounting portion.

5. The image forming apparatus according to claim 4, further comprising a front frame to form the first opening and the second opening.

6. The image forming apparatus according to claim 5, wherein the developing unit comprises at least one first position determining protrusion protruding from a first side of the developing unit in a direction in which the developing unit enters the developing unit storage portion, wherein the front frame comprises at least one first coupling hole formed at a position corresponding to the first position determining protrusion to be coupled to the at least one first position determining protrusion.

7. The image forming apparatus according to claim 5, wherein the developing unit comprises at least one first fixing hole formed through a first side of the developing unit, wherein the front frame comprises at least one second fixing hole formed at a position corresponding to the at least one first fixing hole through the front frame.

8. The image forming apparatus according to claim 6, further comprising at least one guide member formed to extend in a front-back direction of the body and disposed at a lower portion of the developing unit storage portion to guide movement of the developing unit when the developing unit enters the developing unit storage portion to be accommodated therein.

9. The image forming apparatus according to claim 8, wherein the guide member comprises:

a first guide rail to guide a lower end of the developing unit; and a second guide rail disposed on both sides of the first guide rail to guide both lateral surfaces of the developing unit.

10. The image forming apparatus according to claim 8, wherein the developing unit comprises at least one second position determining protrusion protruding from a second side of the developing unit opposite to the first side in a direction in which the developing unit enters the developing unit storage portion.

11. The image forming apparatus according to claim 10, further comprising a rear frame disposed at a position opposite to the front frame with the guide member placed between the front frame and the rear frame, wherein the rear frame comprises at least one second coupling hole formed at a position corresponding to the first position determining protrusion to be coupled to the at least one second position determining protrusion.

12. The image forming apparatus according to claim 11, further comprising a support member coupled to an inside of the rear frame, wherein the support member comprises at least one guide hole formed at a position corresponding to the second coupling hole through the support member to allow the second position determining protrusion to be coupled to the second coupling hole therethrough.

13. The image forming apparatus according to claim 12, wherein the support member comprises:

a first support to support the second side of the developing unit in a direction opposite to the direction in which the developing unit enters the developing unit storage portion; and a second support protruding from the first support into the body to support an upper end of the developing unit in a direction perpendicular to the direction in which the developing unit enters the developing unit storage portion.

14. An image forming apparatus comprising:

a body;

a developing unit disposed in the body;

a first developing unit accommodating portion to accommodate the developing unit such that the developing unit is disposed apart from a path along which a recording medium is transported when the developing unit is installed in the first developing unit accommodating portion; and at least one second developing unit accommodating portion to accommodate the developing unit such that the developing unit forms at least one portion of the path along which the recording medium is transported when the developing unit is installed in the at least one second developing unit accommodating portion, wherein the first developing unit accommodating portion and the at least one second developing unit accommodating portion are disposed at substantially a same height from a bottom portion of the body.

15. The image forming apparatus according to claim 14, wherein the first developing unit accommodating portion and the second developing unit accommodating portion are disposed parallel to each other in a first direction directed from a front of the body to a back thereof.

16. The image forming apparatus according to claim 15, wherein the first developing unit accommodating portion and the second developing unit accommodating portion are disposed spaced apart from each other in a second direction perpendicular to the first direction.

17. The image forming apparatus according to claim 16, further comprising:

a front frame and a rear frame spaced apart from each other in a front-back direction of the body; and a lower frame disposed between the front frame and the rear frame, wherein the lower frame comprises:

a first guide member to guide movement of the developing unit when the developing unit enters the first developing unit accommodating portion to be accommodated therein; and a second guide member disposed to be spaced apart from the first guide member in the second direction and to guide movement of the developing unit when the developing unit enters the second developing unit accommodating portion to be accommodated therein.

18. The image forming apparatus according to claim 16, further comprising a support member coupled to an inner surface of the rear frame, wherein the support member comprises:

a first support to support the developing unit in a direction opposite to the first direction; and a second support to support the developing unit in a third direction perpendicular to both the first direction and the second direction.

19. An image forming apparatus comprising:

a body;

a developing unit disposed in the body;

a developing unit mounting portion to accommodate the developing unit to allow the developing unit to perform image formation;

a developing unit storage portion, enclosed within the body, to accommodate the developing unit, separately from the developing unit mounting portion;

a first opening provided on a front surface of the body to allow the developing unit to enter the developing unit storage portion;

a second opening provided on the front surface of the body to allow the developing unit to enter the developing unit mounting portion; and a cover forming an external appearance of the image forming apparatus and which covers the first opening and second opening, wherein the cover is configured to be openable to provide access to the first opening and second opening.

20. An image forming apparatus, comprising:

a body to enable selective storage of a developing unit in one of at least two locations which are disposed within an interior of the body, one of the locations including a first storage which, when the developing unit is stored therein, forms a portion of a path along which a recording medium is transported; and an optical scanning unit which emits light to form an electrostatic latent image on a photosensitive body of the developing unit, wherein a lower part of the body is configured to store the recording medium before it is transported along the path, an upper part of the body is configured to receive the recording medium after an image is formed on the recording medium and the recording medium is discharged outside of the body, first and second sides of the body connect the upper part of the body to the lower part of the body, another of the at least two locations includes a second storage to store the developing unit, the first storage is disposed between the optical scanning unit and the first side of the body and between the upper part of the body and the lower part of the body, the second storage is disposed between the optical scanning unit and the second side of the body and between the upper part of the body and the lower part of the body, when the developing unit is disposed within the first storage, the photosensitive body is arranged to receive the light emitted from the optical scanning unit, and when the developing unit is stored in the second storage, the developing unit is disposed away from the path along which the recording medium is transported such that the developing unit is unable to perform image formation while stored in the second storage, and such that the photosensitive body of the developing unit is incapable of receiving light emitted from any optical scanning unit of the image forming apparatus.

21. An image forming apparatus comprising:

a body;

a developing unit disposed in the body, the developing unit comprising a photosensitive body to form an electrostatic latent image to be transferred to a transfer roller of the image forming apparatus disposed adjacent to the photosensitive body;

a developing unit mounting portion to accommodate the developing unit to allow the developing unit to perform image formation;

a developing unit storage portion, enclosed within the body, to accommodate the developing unit, separately from the developing unit mounting portion and spaced apart from a path along which a recording medium is transported, such that the developing unit is unable to perform image formation while accommodated in the developing unit storage portion;

an opening provided on a surface of the body to allow the developing unit to enter the developing unit storage portion; and a cover forming an external appearance of the image forming apparatus and which covers the opening, wherein the cover is configured to be openable to provide access to the opening, wherein the photosensitive body of the developing unit is not disposed adjacent to any transfer roller of the image forming apparatus while the developing unit is accommodated in the developing unit storage portion.

22. The image forming apparatus according to claim 1, further comprising a scanning unit configured to scan a recording medium, wherein the scanning unit is disposed above the recording medium support part.

* * * * *